US006657373B1

(12) United States Patent
Tops

(10) Patent No.: US 6,657,373 B1
(45) Date of Patent: Dec. 2, 2003

(54) DEFLECTION UNIT FOR A CATHODE RAY TUBE AND METHOD OF MANUFACTURING A SADDLE-SHAPED DEFLECTION COIL

(75) Inventor: Martinus Josephus Tops, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 130 days.

(21) Appl. No.: 09/704,518

(22) Filed: Nov. 2, 2000

(30) Foreign Application Priority Data

Nov. 4, 1999 (EP) ..... 99203643

(51) Int. Cl.[7] ..... H01J 29/70; H01J 29/50; H01H 5/00

(52) U.S. Cl. ..... 313/440; 313/413; 313/443; 335/213

(58) Field of Search ..... 313/440, 443, 313/421, 413; 335/213, 210, 299

(56) References Cited

U.S. PATENT DOCUMENTS 4,612,525 A * 9/1986 Sluyterman et al. ..... 335/213
5,001,390 A * 3/1991 Vink et al. ..... 313/431
5,013,964 A * 5/1991 Vink et al. ..... 313/440
5,589,729 A * 12/1996 Descombes et al. ..... 313/426
5,804,913 A 9/1998 Grubben et al. ..... 313/440
6,351,200 B1 * 2/2002 Azzi et al. ..... 335/213

FOREIGN PATENT DOCUMENTS

DE 1803074 5/1970 ..... H04N/5/64

OTHER PUBLICATIONS

RD 329114.

Japanese Patent Abstract 08129956A.

* cited by examiner

*Primary Examiner*—Ashok Patel
*Assistant Examiner*—German Colón

(57) ABSTRACT

A deflection unit for a cathode ray tube comprises a coil support (5). On its inner surface the coil support 5 comprises protrusions (34) having reference planes in the x-y direction. The coils provided on the inner side of the coil support have lying front flanges (8,9) which have corresponding reference surfaces (31), also extending in the x-y plane, preferably in an inner winding window (51).

10 Claims, 6 Drawing Sheets

Figure 1:
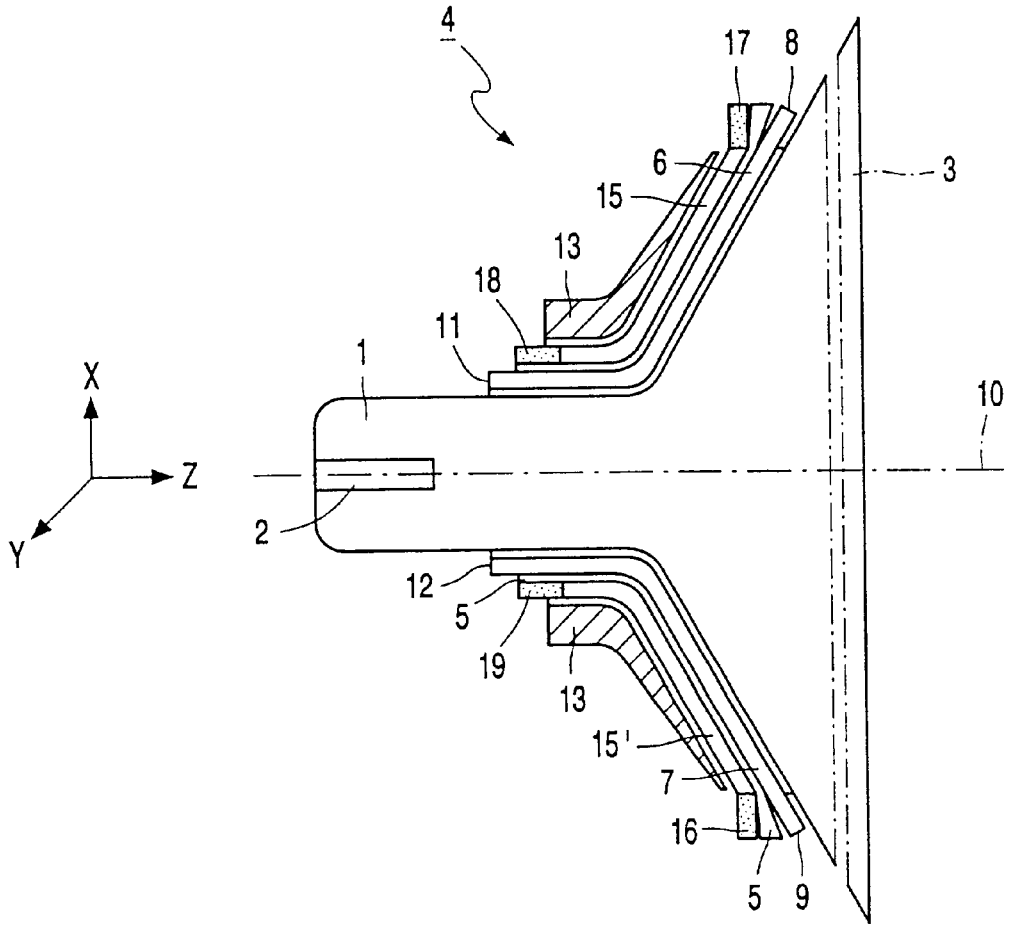

DEFLECTION UNIT FOR A CATHODE RAY TUBE AND METHOD OF MANUFACTURING A SADDLE-SHAPED DEFLECTION COIL

The invention relates to a deflection unit for a cathode ray tube comprising at least a pair of saddle-shaped coils having coil portions, the coil portions comprising a front and a rear end portion and the deflection unit comprising a coil support, whose inner side is provided with the pair of coils.

The invention also relates to a method of manufacturing a saddle-shaped deflection coil having a front and a rear end portion.

Such a deflection unit is known from Research disclosure September 1991, page 715 in which a deflection unit having a line coil is described. The line coil is secured to the support after the position of the deflection coil is fixed, using a fixing member.

Although this known deflection unit yields satisfactory results in many instances i.e. an accurate position of the deflection coil on the support, less than satisfactory results have been achieved for designs in which the front end portion is of the lying flange type, i.e. following the general contour of the tube of the cathode.

It is an object of the invention to provide a deflection unit for a cathode ray tube in which, on average, the accuracy of positioning the deflection coil and support with respect to each other is improved.

To this end, the deflection unit in accordance with the invention is characterized in that each pair of deflection coils is provided at the front end portion, being of the lying front flange type, with two or more reference surfaces within a winding window, said surfaces extending in a plane (x-y) perpendicular to the longitudinal direction of the deflection unit (z-axis), and the support is provided with protrusions having corresponding surfaces.

In the deflection unit, the coil is provided with two or more surfaces within a winding window extending in the x-y plane. These surfaces define a reference plane for the coil, which plant is perpendicular to the longitudinal axis (z-axis). The coil support comprises corresponding protrusions also defining a pair of surfaces extending in the x-y plane. The matching surfaces enable the position of the coils in the z-direction to be accurately determined, reducing inaccuracy in this positioning and thus eliminating or at least reducing a source of error. The coil support is preferably provided with a hooking part at a part corresponding to the rear end portion of the inner window of the coil to secure the coil on the support. The hooking part fixes the coil while the protrusion in co-operation with the surfaces in the coil determines the z-position. The coil support is preferably also provided with means for pushing each coil against a longitudinal rib. In such an embodiment, the position of the coil is even better determined.

These and other aspects of the invention are apparent from and will be elucidated with reference to the embodiments described hereinafter. Similar components in the Figures have identical reference numerals.

Figure 2A:
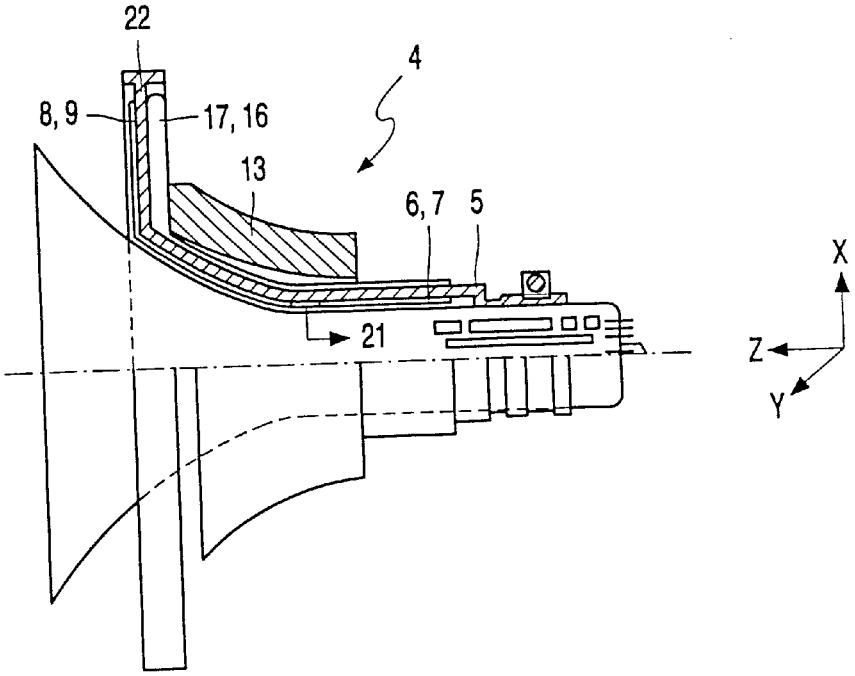
Figure 2B:
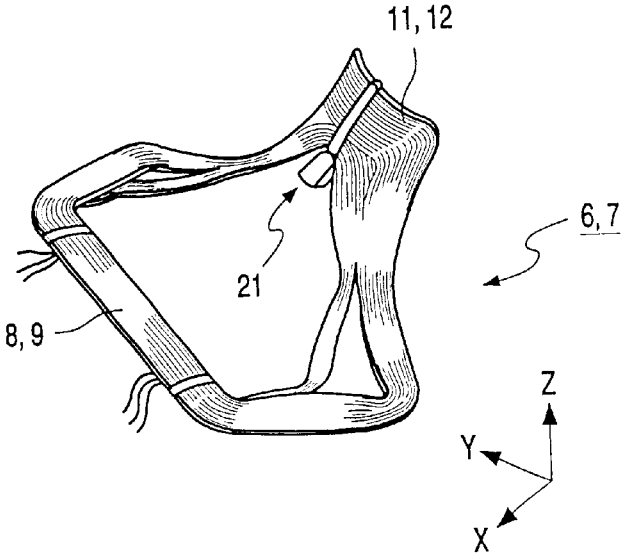
Figure 3:
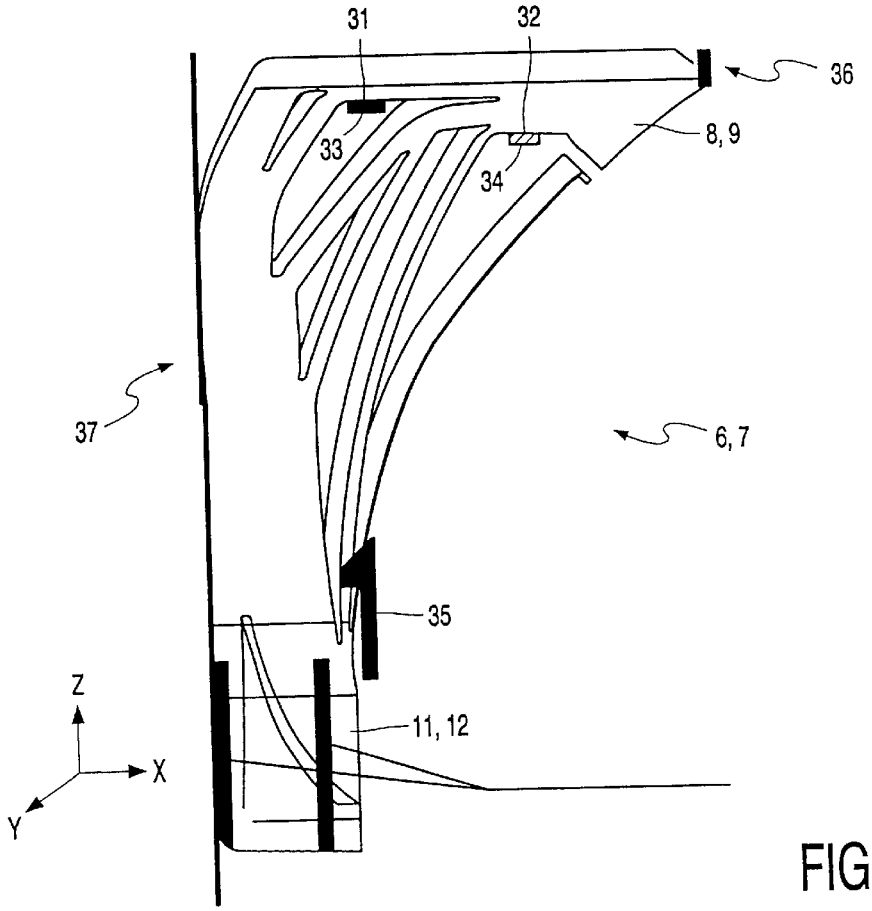
Figure 4:
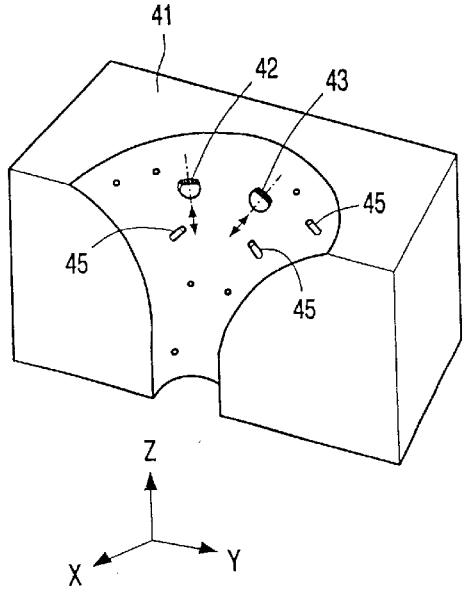
Figure 5:
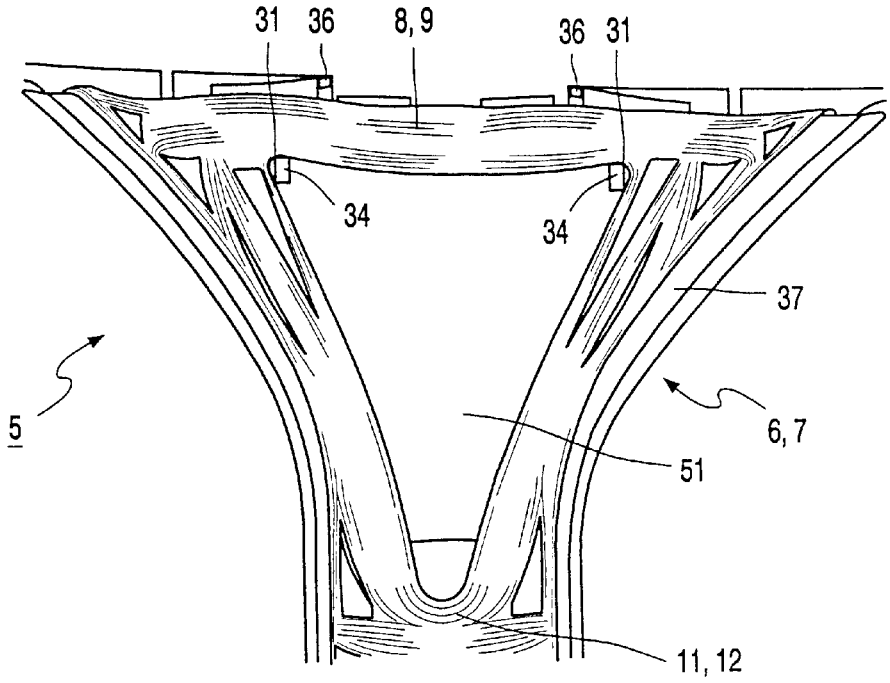
Figure 6:
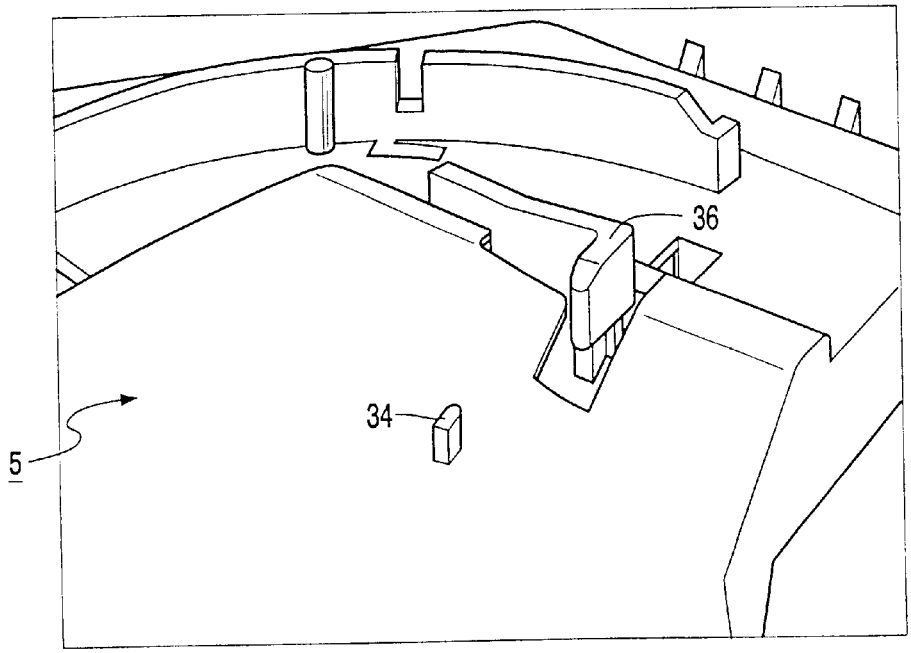
Figure 7:
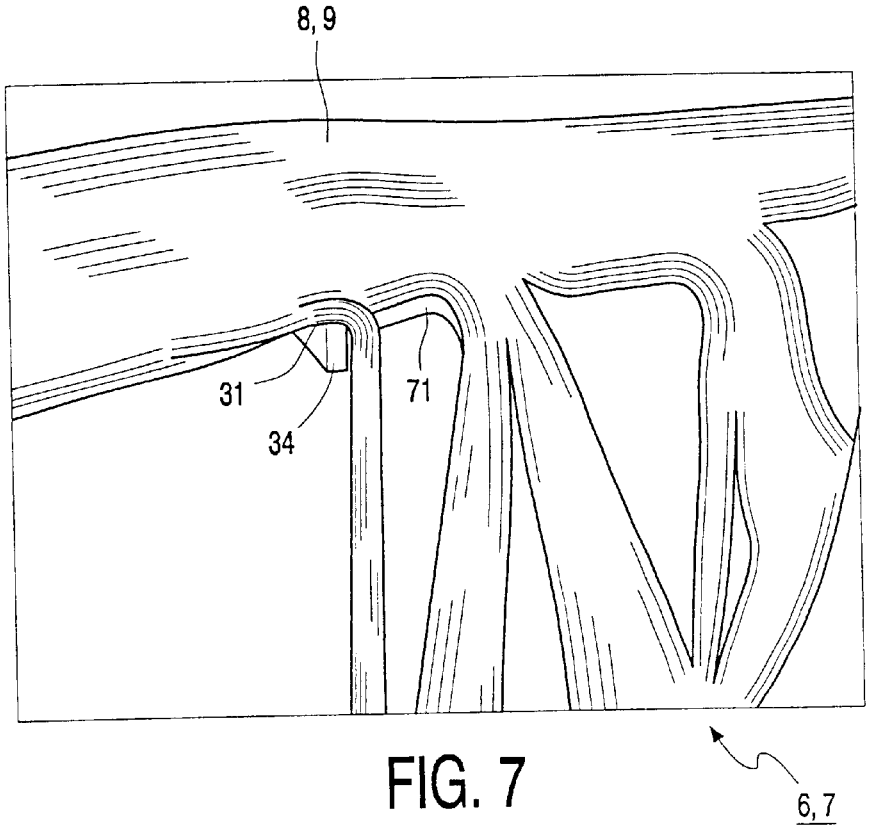
Figure 8:
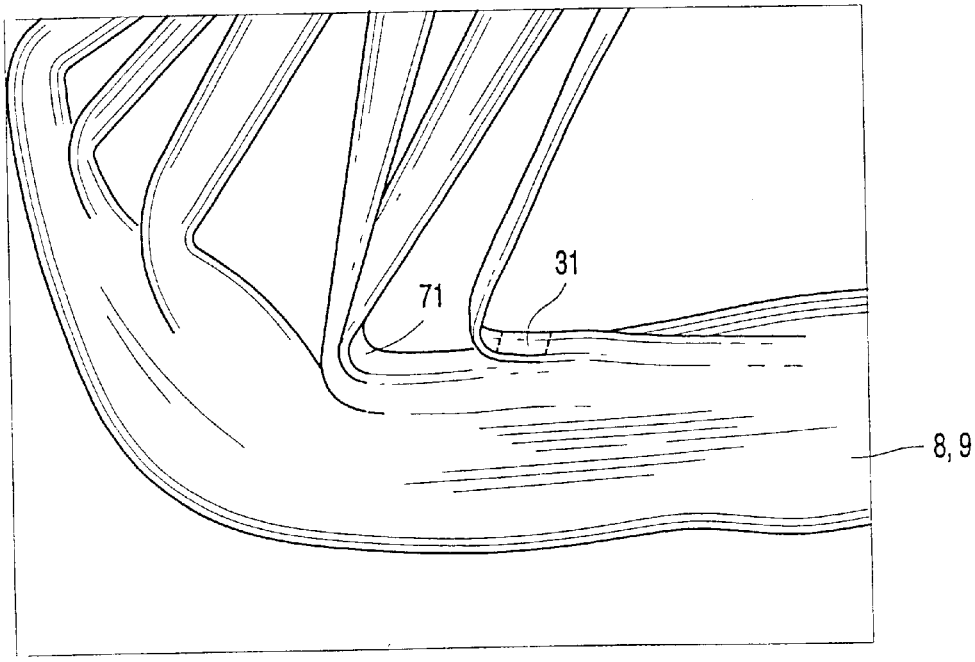

In the drawings:

FIG. 1 is a diagrammatic longitudinal section through a part of a picture display tube with a deflection system, FIGS. 2A and 2B illustrate the known deflection unit, FIG. 3 illustrates the deflection unit in accordance with the invention, FIG. 4 schematically shows a winding mandrel for the method in accordance with the invention, FIG. 5 is a front view of a coil support 5 provided on its inner surface with a line coil, FIG. 6 shows in more detail the flange part of the coil support with the protrusions, FIGS. 7 and 8 illustrate in more detail the reference surfaces of the line coil and the corresponding protrusions in or on the coil support.

Figure 9:
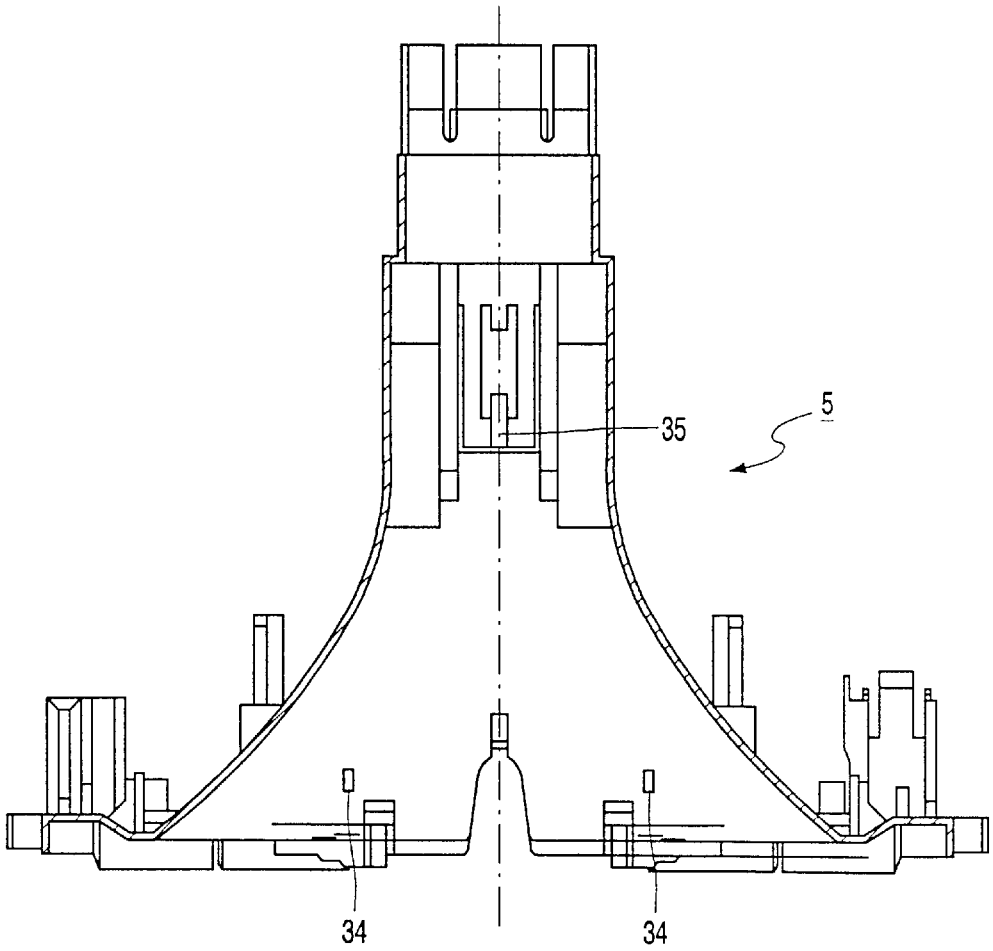

FIG. 9 shows the coil support in cross section.

FIG. 1 shows a color cathode ray tube 1 comprising an electron gun system 2 for generating three electron beams which are directed towards a display screen 3 having a repetitive pattern of red, green and blue phosphor elements. An electromagnetic deflection unit 4 is arranged around the path of the electron beams substantially co-axially with the axis of the tube between the electron gun system 2 and the display screen 3. The deflection unit 4 comprises a funnel-shaped coil support 5 which supports line deflection coils 6, 7 at its inner side for deflecting the electron beams generated by the electron gun system 2 in the line direction which is usually the horizontal direction. The flared line deflection coils 6, 7 are of the saddle type and have a front flange 8, 9 at their widest end, which flanges are formed by the connection wires between the axial conductor packets and lie substantially along the funnel-shaped part of the cathode ray tube. At their narrowest end, the coils 6, 7 have packets of connection wires 11, 12 forming the rear end flanges which connect the axial conductor packets of each coil 6, 7 and are laid across the surface of the neck part of the display tube. In general, the flanges could be of the 'lying type' in which the connection wires follow the surface of the tube (lying against the surface of the tube) or of the 'upstanding type' in which the connection wires form a flange 'standing up' from the surface of the tube.

The coil support supports two saddle-shaped field deflection coils 15, 15' at its outer side for deflecting the electron beams generated by the electron gun system 3 in a field direction which is usually the vertical direction. The deflection coils 15, 15' have packets of connection wires 18, 19 forming the rear end flanges which connect the axial conductor packets of each coil and front flanges 17, 16 at their widest end, which flanges are formed by the connection wires between the axial conductor packets and are substantially transverse to the axis 10 of the display tube. A ferromagnetic annular core 13 surrounds the two coil sets. FIG. 1 shows a deflection unit in which the line deflection coils 6, 7 are of the type having lying front and rear flanges, whereas the field deflection coils 15, 15' have an upstanding front and a lying rear flange.

FIGS. 2A and 2B illustrate the deflection unit known from Research disclosure September 1991, page 715. The deflection unit 4 comprises a coil support 5 with a front flange 22, and an annular core 13. Line deflection coils 6, 7 having lying rear end flanges 11, 12 and upstanding front end flanges 8, 9 are arranged on the inner side of the coil support 5. The coil support is provided with a hooking part 21, which hooks the line deflection coils and presses them against the front end flange 22 of coil support 5.

Although the deflection unit shown in FIGS. 2A and 2B yields satisfactory results in many instances, i.e. an accurate position of the deflection coil on the support, less than satisfactory results have been found for designs in which the front end portion is of the lying flange type, i.e. following the general contour of the tube of the cathode.

FIG. 3 shows line deflection coils 6, 7 for a deflection unit in accordance with the invention, showing also schematically a few parts of the coil support 5. The line deflection coil has a rear lying flange 11, 12 and a front lying flange 8,9. The front lying flange is provided with two flat reference surfaces 31, 32, extending in the x-y plane, i.e.

perpendicular to the z-axis. The coil support comprises parts 33 and 34 which have surfaces corresponding to the reference surfaces 31, 32. The coil support further comprises a hooking part 35, a part 36 which pushes the coil in the x-direction to a ridge 37. The surfaces 31, 32 and the parts 33, 34 stabilize the position of the coil 6, 7 vis-à-vis the coil support 5 in the z-direction while still allowing an accurate position in the x and y directions.

FIG. 4 is a diagrammatic front view of the inner part of a winding mandrel 41. The winding mandrel is provided with winding pins 45 as is usual and with profile pins 42, 43 which have surfaces extending in the x-y plane. It is to be noted that winding pins 45 are oriented perpendicularly to the inner surface of the mandrel (and thus give the flare shape of the inner surface at an angle to the x-y plane, and a rounded shape, thus not providing a flat reference surface in the x-y plane). The impression of these winding pins made in the coil therefore does not define reference surfaces that can be used for accurate positioning in the z-direction. The profile pins 42, 43 are provided for this purpose.

FIG. 5 is a front view of a coil support 5 provided on its inner surface with a line deflection coil 6, 7 having lying rear flanges 11, 12 and lying front flanges 8, 9. The coil support is provided with protrusions 34, and pushing means 36, as well as with ridges 37. The reference surfaces of the coil and the protrusions 34 are preferably provided in the inner winding window 51 as shown in FIG. 5. For clarity, the hooking part which in preferred embodiments is part of the coil support (or is provided on or in the coil support) is not shown in FIG. 5.

FIG. 6 shows in more detail the flange part of the coil support with the protrusions 34 (also showing that said protrusions have a surface extending in the x-y plane) and pushing means 36.

FIGS. 7 and 8 show in more detail line deflection coils 6,7 having a reference surface 31 lying against a protrusion 34 (see FIG. 7). Also shown is the impression 71 from a winding pin. This impression 71 is round and extends at an angle to the x-y plane. Such impressions cannot be used to accurately position the coil in the z-direction.

In summary, the invention can be described as follows. A deflection unit for a cathode ray tube comprises a coil support (5). On its inner surface, the coil support 5 comprises protrusions (34) having reference planes in the x-y direction. The coils provided on the inner side of the coil support have lying front flanges (8,9) which have corresponding reference surfaces (31), also extending in the x-y plane, preferably in an inner winding window (51).

What is claimed is:

1. A deflection unit for a cathode ray tube, said deflection unit comprising:

a pair of deflection coils having coil portions, the coil portions including a front end portion and a rear end portion; and a coil support, whose inner side is provided with the pair of deflection coils, wherein the pair of deflection coils is provided at the front end portions as a lying front flange type, with two or more flat surfaces within a winding window of said coil support, and wherein the front end portions extend in a plane (x-y) perpendicular to a longitudinal direction of the deflection unit (z-axis), and said coil support is provided with protrusions having corresponding flat surfaces.

2. A deflection unit as claimed in claim 1, wherein said coil support is provided at a rear end with a hooking part for hooking the pair of deflection coils.

3. A deflection unit as claimed in claim 1, wherein the flat surfaces are provided within an inner winding window.

4. A deflection unit as claimed in claim 1, wherein said coil support is provided with a means for pushing the pair of deflection coils in a direction perpendicular to the longitudinal direction.

5. A cathode ray tube, comprising:

an electron gum for generating an electron beam; and a deflection unit arranged around a path of the electron beam, said deflection unit including a pair of deflection coils having coil portions, the coil portions including a front end portion and a rear end portion, and a coil support, whose inner side is provided with the pair of deflection coils, wherein the pair of deflection coils is provided at the front end portions as a lying front flange type with two or more flat surfaces within a winding window of said coil support, and wherein the front end portions extend in a plane (x-y) perpendicular to a longitudinal direction of the deflection unit (z-axis), and said coil support is provided with protrusions having corresponding surfaces.

6. A deflection unit as claimed in claim 5, wherein said coil support is provided at a rear end with a hooking part for hooking the pair of deflection coils.

7. A deflection unit as claimed in claim 5, wherein the flat surfaces are provided within an inner winding window.

8. A deflection unit as claimed in claim 5, wherein said coil support is provided with a means for pushing the pair of deflection coils in a direction perpendicular to the longitudinal direction.

9. A deflection unit for a cathode ray tube, said deflection unit comprising:

a coil support having an inner side and an outer side, said coil support including at least one protrusion extending from said inner side; and a first deflection coil having a front end portion including at least one flat surface extending in a plane (x-y) perpendicular to a longitudinal axis of said coil support, wherein a first flat surface of said at least one flat surface lies against a first protrusion of said at least one protrusion.

10. A deflection unit as claimed in claim 9, further comprising:

a second deflection coil supported on said outer surface of said coil support; and an annular core surrounding said first deflection coil and said second deflection coil.

* * * * *